United States Patent [19]

Toms

[11] Patent Number: 4,889,262

[45] Date of Patent: Dec. 26, 1989

[54] LOCKING SYSTEM FOR PUMP DISPENSER

[75] Inventor: Ray A. Toms, Atlantic Highlands, N.J.

[73] Assignee: L'Oreal, S. A., Paris, France

[21] Appl. No.: 203,277

[22] Filed: Jun. 7, 1988

[51] Int. Cl.[4] ..... B67D 5/32

[52] U.S. Cl. ..... 222/153; 222/384; 222/321

[58] Field of Search ..... 222/153, 182, 321, 383, 222/384, 385, 402.11, 402.13, 530

[56] References Cited

U.S. PATENT DOCUMENTS

| | | | |
|---|---|---|---|
| 2,706,660 | 4/1955 | Johnson et al. | 222/402.11 X |
| 2,715,481 | 8/1955 | McGhie et al. | 222/153 |
| 3,006,340 | 10/1961 | Meshberg | 222/402.11 X |
| 3,050,219 | 8/1962 | Sagarin et al. | 222/402.11 X |
| 3,252,626 | 5/1966 | Belka | 222/402.11 |
| 3,306,497 | 2/1967 | Kenney et al. | 222/182 |
| 3,314,572 | 4/1967 | Pungitore | 222/145 X |
| 3,401,843 | 9/1968 | Ahrens et al. | 222/384 X |
| 3,422,996 | 1/1969 | Lipman . | |
| 3,426,948 | 2/1969 | Stirling | 222/402.11 |
| 3,531,026 | 9/1970 | Venus Jr. | 222/402.11 |
| 3,729,119 | 4/1973 | Sette et al. | 222/182 X |
| 3,797,705 | 3/1974 | Cooprider . | |
| 3,837,537 | 9/1974 | Baldwin . | |
| 3,949,906 | 4/1976 | Pettersen et al. . | |
| 4,234,093 | 11/1980 | Tyson . | |
| 4,343,417 | 8/1982 | Corsette . | |
| 4,368,830 | 1/1983 | Soughers . | |
| 4,369,899 | 1/1983 | Magers et al. . | |
| 4,424,919 | 1/1984 | Knox et al. . | |
| 4,458,832 | 7/1984 | Corsette . | |
| 4,479,589 | 10/1984 | Ford . | |
| 4,496,082 | 1/1985 | Corsette . | |

*Primary Examiner*—Kevin P. Shaver

*Attorney, Agent, or Firm*—Brumbaugh, Graves, Donohue & Raymond

[57] ABSTRACT

In a liquid dispenser having a vertically reciprocable plunger, the plunger is immobilized by use of a locking system. The locking system comprises a turret collar which is mounted on the cap of the dispenser. A discharge channel member contains a discharge passage which communicates with the vertically reciprocable plunger and the member extends laterally substantially beyond the circumference of the turret collar. The collar has a vertical slot therein adapted to receive the discharge channel member and to permit full vertical movement thereof in conjunction with the operation of the liquid dispenser. A locking groove in the turret collar communicates with the vertical slot and is adapted to retain the discharge channel member, therefore immobilizing the vertically reciprocable plunger, after rotation of the turret collar or rotation of the discharge channel member in a horizontal direction.

4 Claims, 1 Drawing Sheet

LOCKING SYSTEM FOR PUMP DISPENSER

BACKGROUND OF THE INVENTION

This invention relates to the field of manually operated, hand held, liquid dispenser pumps and, more particularly, to pumps having plungers which may be locked to prevent the inadvertent discharge or leakage of the product.

A variety of structures have been employed as a means for locking down the plunger of a hand held, liquid dispenser pump during periods of non-use. One such locking means is the use of a threaded engagement between the plunger and the container cap. A problem with this type of locking engagement, however, is that the unthreading of the plunger often leads to loosening of the cap from the container. Another structure used as a locking means is a protective overcap. Although the cap immobilizes plunger reciprocation during periods of non-use, the cap represents a supplemental accessory which is often misplaced. A third structure used as a locking means are locking tongues or fingers which are deflectable into the path of reciprocation. Reliance on the elastic memory of the tongues or fingers for retracting them away from the path of reciprocation to permit actuation of the pump may eventually render the pump inoperable if the elastic memory is lost or diminishes during the shelf life of the product.

All of these various approaches for immobilizing the plunger are either unreliable, somewhat cumbersome, or complicated and therefore expensive.

SUMMARY OF THE INVENTION

It is an object of the present invention to improve upon the prior art locking means for a hand held liquid dispenser so as to simplify the locking and unlocking operation by the provision of a locking system which is not only easy to operate but which is also simple and economical to manufacture.

Another object of the present invention is to provide a simple and inexpensive locking system for a hand held liquid dispenser that is effective to prevent accidental actuation in the event that the dispenser is mishandled or is laid on its side or inverted.

A further object of the present invention is to provide such a locking system for a hand held liquid dispenser wherein the locking system is included with the overall package of the hand held liquid dispenser and the locking system does not interfere with and adversely affect the dispensation of a predictable uniform portion of the liquid product during each stroke of the pump.

The objects are attained in accordance with the present invention, in a hand held liquid dispenser with a vertically reciprocable plunger and an actuating button, by the provision of a locking system for the vertically reciprocable plunger. The locking system comprises a turret collar which projects upwardly from, and is mounted on, the cap of the container and generally surrounds and guides the actuating button in its vertical reciprocable path. The turret collar has a vertical slot therein adapted to receive the horizontal discharge channel member which extends laterally substantially beyond the circumference of the turret collar, and to permit full vertical movement thereof in conjunction with operation of the dispenser. A locking groove in the turret collar communicates with the vertical slot, and is adapted to receive and retain the discharge channel member on rotation of the turret collar or on rotation of the discharge channel member in a horizontal direction.

In another embodiment of the invention, the locking groove of the turret collar is adapted to receive and retain the discharge channel member on rotation of the collar (or rotation of the discharge channel member in a horizontal direction) after sufficient pressure is applied on the upper end of the actuating button to slightly depress the discharge channel member until it reaches the opening of the locking groove.

BRIEF DESCRIPTION OF THE DRAWINGS

The invention will be more fully explained in the following description of the preferred embodiment, as represented in the accompanying drawings, in which.

DETAILED DESCRIPTION OF THE INVENTION

Figure 1:
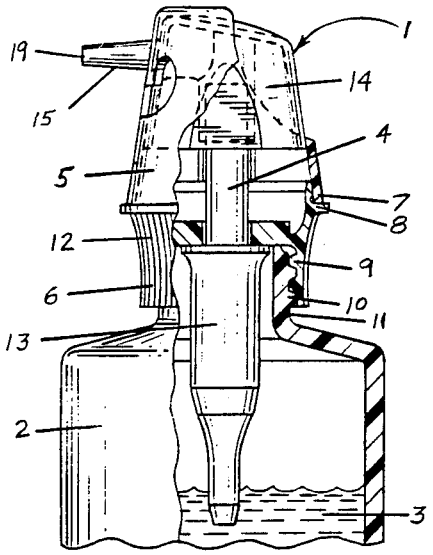
FIG. 1 is a partially cut away and partially in section view of the hand held dispenser of the invention showing the vertically reciprocable plunger, the horizontal discharge channel member and the turret collar.
Figure 2:
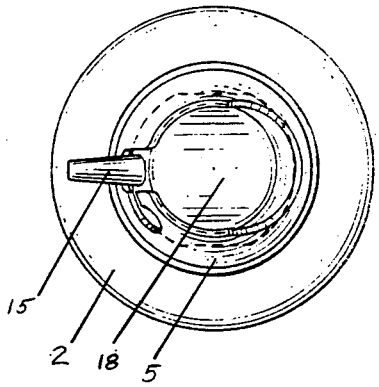
FIG. 2 is a top view of the hand held dispenser of the invention showing the relation of the horizontal discharge channel member and the turret collar.

Turning now to the drawings wherein like reference characters refer to like and corresponding parts throughout the several views, a dispensing pump for liquids according to the invention is generally designated 1 in FIG. 1 and is shown mounted on a container 2 of liquid 3 to be dispensed. The dispenser includes a hollow vertically reciprocable upwardly biased plunger 4 surrounded by one of the major components of the locking system, a turret collar 5, which projects upwardly from, and is mounted on a container cap 6. The turret collar 5 has a lip 7 at its lower end for engagement with a groove 8 at the upper end of the container cap 6. The fit between the turret collar 5 and the container cap 6 is such that the collar 5 may rotate if sufficient torque is applied to the collar 5. The collar 5 is not merely loosely held onto the container cap 6. The container cap 6 is internally threaded at its lower end 9 for engagement with external threads 10 of the container neck 11. The container cap 6 may be provided with adjacent vertical knurls 12 to facilitate the loosening and tightening of the container cap 6 on the container neck 11. The hollow vertically reciprocable plunger 4 operates in a pump cylinder 13 and is attached to an actuating button 14 which includes a horizontal discharge channel member 15. The discharge channel member 15 contains a discharge passage which communicates with the hollow vertically reciprocable plunger 4, and the member 15 extends laterally substantially beyond the circumference of the turret collar 5 as illustrated in FIG. 2. The collar 5 has a vertical slot 16 therein adapted to receive the discharge channel member 15 and to permit full vertical movement thereof, and an upwardly curved locking groove 17 which is adapted to receive and retain the discharge channel member 15 on rotation of the turret collar 5, or instead, rotation of the discharge channel member 15 in a horizontal direction.

The application of pressure on the upper end 18 of the actuating button 14, reciprocates the plunger 4 and causes the liquid 3 to be dispensed from the container 2 through a discharge nozzle 19 of the horizontal discharge channel member 15 as is well known in the art.

Figure 3:
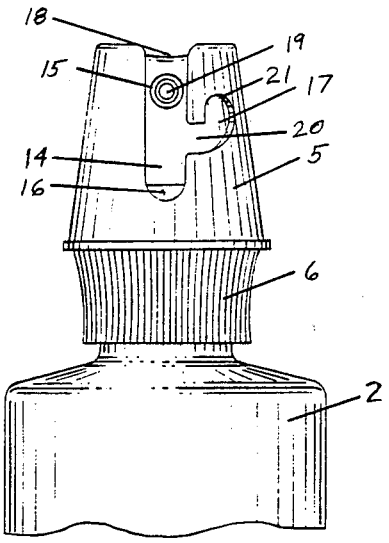
FIG. 3 is a front view thereof, showing the horizontal discharge channel member, the turret collar, the vertical slot, and the upwardly curved locking groove.
Figure 4:
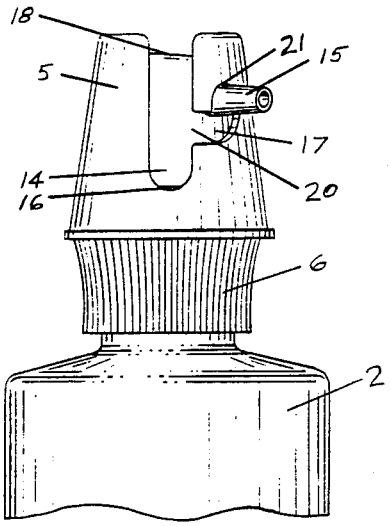
FIG. 4 is a view similar to FIG. 3 but with the horizontal discharge channel member in a locked position.

In accordance with the invention as illustrated in FIGS. 3 and 4, the hollow vertically reciprocable plunger 4 is immobilized to prevent the accidental discharge of a liquid, by positioning the horizontal discharge channel member 15 into the upwardly curved locking groove 17. This positioning is achieved by applying sufficient pressure on the upper end 18 of the actuating button 14 to slightly depress the discharge channel member 15, along the vertical slot 16, until it reaches the opening 20 of the upwardly curved locking groove 17. The opening 20 of the upwardly curved locking groove 17 is located approximately midway between the top and bottom of the vertical slot 16 on the turret collar 5. After the discharge channel member 15 is lined up with the opening 20 of the upwardly curved locking groove 17, it is necessary only to rotate the discharge channel member 15 out of the vertical slot in a horizontal direction. This action will cause the vertically reciprocable plunger 4 to lock as the discharge channel member 15 lodges against the turret collar surface 21 above the upwardly curved locking groove 17 illustrated in FIG. 4. The means which urge the hollow vertically reciprocable plunger 4 to its upper most position will also urge the discharge channel member 15 against the collar surface 21, therefore urging the plunger 4 into a locked position. The means will also avoid any disengagement while the plunger 4 is in its locked position.

In order to place the dispensing pump 1 in readiness for use from the locked position of FIG. 4, it is necessary only to slightly apply pressure on the upper end 18 of the actuating button 14 and in conjunction, to rotate the discharge channel member 15 toward the vertical slot in a horizontal direction. In a preferred embodiment of the invention, the upwardly curved locking groove 17 is designed in such a manner that the path of the discharge channel member 15 will automatically follow a direction towards the vertical slot when pressure is applied on the upper end 18 of the actuating button 14. When sufficient rotation has occurred, the hollow plunger 4 may be freely reciprocated by intermittent finger pressure on the upper end 18 of the actuating button 14, to expel as much of the liquid 3 of the container 2 as may be desired.

Figure 5:
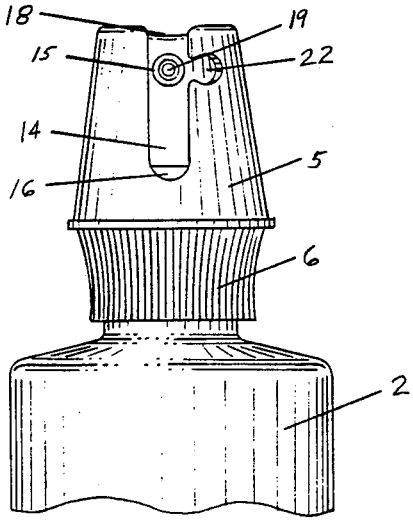
FIG. 5 is a front view of another embodiment of the invention showing the horizontal discharge channel member, the turret collar, the vertical slot and the perpendicular locking groove.
Figure 6:
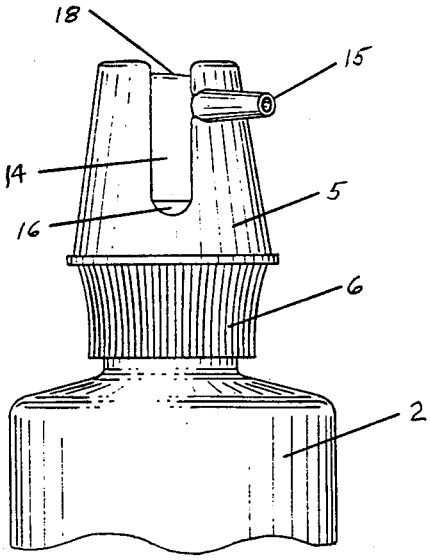
FIG. 6 is a view similar to FIG. 5 but with the horizontal discharge channel member in a locked position.

With reference now to FIGS. 5 and 6 there is disclosed an alternate embodiment of the invention wherein identical elements are identified by the same numerals as in the previous embodiments. In this embodiment the distinction lies with the substitution of the upwardly curved locking groove 17 shown in FIGS. 3 and 4 with a perpendicular locking groove 22. The perpendicular locking groove 22 is located perpendicular to the vertical slot 16 on the turret collar 5, and in such a manner that the discharge channel member 15 lines up with the perpendicular locking groove 22 when the hollow vertically reciprocable plunger 4 is urged into its uppermost position. In this embodiment, the reciprocable plunger 4 is immobilized by snapping the horizontal discharge channel member 15 into the perpendicular locking groove 22. This positioning is achieved by simply rotating the discharge channel member 15 out of the vertical slot in a horizontal direction. There is no need to apply pressure on the upper end 18 of the actuating button 14 which may cause a small amount of liquid 3 to be dispensed.

In order to place the dispensing pump 1 in readiness for use, from the locked position of FIG. 6, it is necessary only to unsnap the horizontal discharge channel member 15 by rotating the discharge channel member 15 toward the vertical slot in a horizontal direction. When sufficient rotation has occurred, the hollow plunger 4 may be freely reciprocated by intermittent finger pressure on the upper end 18 of the actuating button 14, to expel as much of the liquid 3 of the container 2 as may be desired.

In another embodiment of the invention, which contains identical elements as identified by the earlier embodiments, the distinction lies with the substitution of the rotation of the discharge channel member 15 in a horizontal direction with the rotation of the turret collar 5 around its axis to engage or disengage the discharge channel member 15 into or out of the locking groove 17/22.

It is an important feature of the invention that there is provided a first means responsive to angular movement of the discharge channel member 15 in a horizontal direction or the turret collar 5 around its axis in a first direction to engage the locking system and in addition there is provided a second means responsive to angular movement of the discharge channel member 15 in a horizontal direction or the turret collar 5 around its axis in a second or reverse direction to disengage the locking system.

It should also be noted that with the turret collar 5 in place, there still exists the capability of rotating the entire collar/discharge channel member combination even when the vertically reciprocable plunger 4 is in the locked position. This may be required to facilitate alignment of the container 2 for packaging or shipping in volume.

With such arrangements as described above, it can be seen that any tendency to inadvertently unlock the vertically reciprocable plunger is prevented and any interference between the operation of the dispenser and the locking system during the plunger's reciprocation is avoided.

While the invention has been illustrated and described as embodied in a locking system of a pump dispenser, it is not intended to be limited to the details shown, since various modifications and structural changes may be made without departing in any way from the spirit of the present invention.

I claim:

1. In a hand held liquid dispenser comprising a container for liquid to be dispensed, a container cap mounted on the container, a hollow vertically reciprocable plunger mounted on the container through which the liquid is dispensed, an actuating button having a horizontally projecting discharge channel member which communicates with the hollow vertically reciprocable plunger, and means urging the hollow vertically reciprocable plunger to its uppermost position, the improvement comprising the provision of a locking system for said vertically reciprocable plunger, the system comprising:

a turret collar mounted on the container cap which projects upwardly and generally surrounds and guides the actuating button on its vertical reciprocable path, said turret collar having a vertical slot formed in the wall thereof adapted to receive the horizontally projecting discharge channel member which extends substantially beyond the circumference of the turret collar, said vertical slot being sufficiently long to permit full vertical movement of the discharge channel member in conjunction with operation of the hand held liquid dispenser, and a locking groove formed in the wall of said turret collar communicating with the vertical slot, said locking groove comprising a horizontally extending groove portion joining a vertically oriented groove at an upwardly curved portion, said vertically oriented groove having a closed upper end spaced a first distance below the uppermost position of the top of said actuating button and the opening of said horizontally extending groove portion being spaced a second greater distance below the uppermost position of the top of said actuating button so as to receive the discharge channel member on depression of said actuating button by an amount substantially equal to said second distance and relative rotation of said discharge member and said turret collar, said plunger urging means, when pressure is released from the actuating button, forcing said discharge channel member upwardly along said upwardly curved portion and into engagement with the closed upper end of said vertical slot.

2. A hand held liquid dispenser as defined in claim 1, wherein the curvature of the upwardly curved portion of said locking groove causes the discharge channel member, when pressure is applied on the upper end of the actuating button, to leave its locked position and automatically follow said curved portion in a direction towards the vertical slot.

3. In a hand held liquid dispenser comprising a container for liquid to be dispensed, a container cap mounted on the container, a hollow vertically reciprocable plunger mounted on the container through which the liquid is dispensed, an actuating button having a horizontally projecting discharge channel member which communicates with the hollow vertically reciprocable plunger, and means urging the hollow vertically reciprocable plunger to its uppermost position, the improvement comprising the provision of a locking system for said vertically reciprocable plunger, the system comprising:

a turret collar mounted on the container cap which projects upwardly therefrom and generally surrounds and guides the actuating button in its vertical reciprocable path, said turret collar having a vertical slot formed in the wall thereof adapted to receive said horizontally projecting discharge channel member which extends substantially beyond the circumference of the turret collar, said vertical slot being sufficiently long to permit full vertical movement of the discharge channel member in conjunction with the operation of the hand held liquid dispenser, and a locking groove formed in the wall of said turret collar communicating with the vertical slot, said locking groove comprising a horizontal groove joining a vertically oriented groove at an upwardly curved portion with the opening of the horizontal groove located approximately midway between the top and bottom of said vertical slot to receive and retain the discharge channel member on relative rotation of said member and the turret collar.

4. A hand held liquid dispenser as defined in claim 3, wherein the curvature of the upwardly curved portion of said locking groove causes the discharge channel member, when pressure is applied on the upper end of the actuating button, to leave its locked position and automatically follow said curved portion in a direction toward the vertical slot.

* * * * *